US011454226B2

(12) United States Patent
Vazquez et al.

(10) Patent No.: US 11,454,226 B2
(45) Date of Patent: Sep. 27, 2022

(54) ELECTRIC OFF-AXIS OPPOSING PISTON LINEAR ACTUATOR PUMPING SYSTEM

(71) Applicant: Schaeffler Technologies AG & Co. KG, Herzogenaurach (DE)

(72) Inventors: Andre Vazquez, Fort Mill, SC (US); Craig Hooker, Indian Land, SC (US); Michael Conlin, Rock Hill, SC (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 17/153,182

(22) Filed: Jan. 20, 2021

(65) Prior Publication Data

US 2021/0222682 A1 Jul. 22, 2021

Related U.S. Application Data

(60) Provisional application No. 62/963,575, filed on Jan. 21, 2020.

(51) Int. Cl.

| | |
|---|---|
| ***F04B 23/06*** | (2006.01) |
| ***F04B 53/14*** | (2006.01) |
| ***F04B 17/03*** | (2006.01) |
| ***F04B 49/06*** | (2006.01) |
| *E21B 43/26* | (2006.01) |

(52) U.S. Cl.

CPC ..... *F04B 23/06* (2013.01); *F04B 17/03* (2013.01); *F04B 49/06* (2013.01); *F04B 53/14* (2013.01); *E21B 43/2607* (2020.05)

(58) Field of Classification Search

CPC ..... F04B 23/06; F04B 17/03; F04B 49/06; F04B 53/14; E21B 43/2607

See application file for complete search history.

(56) References Cited

U.S. PATENT DOCUMENTS

| | | | | |
|---|---|---|---|---|
| 3,771,918 | A * | 11/1973 | Winter | F04B 9/02 92/136 |
| 6,074,170 | A | 6/2000 | Bert et al. | |
| 6,328,536 | B1 * | 12/2001 | Zebuhr | F04B 25/005 417/259 |
| 6,602,060 | B2 * | 8/2003 | Zebuhr | F04B 9/025 92/240 |
| 8,789,601 | B2 | 7/2014 | Broussard et al. | |
| 8,920,145 | B2 * | 12/2014 | Brown | F15B 7/08 92/136 |
| 9,103,193 | B2 * | 8/2015 | Coli | B62D 63/06 |
| 9,140,110 | B2 * | 9/2015 | Coli | F01D 15/10 |
| 9,562,420 | B2 * | 2/2017 | Morris | F02C 3/04 |
| 9,784,265 | B2 * | 10/2017 | Hines | F04B 45/053 |
| 2018/0363436 | A1 * | 12/2018 | Coli | B01F 35/3204 |

FOREIGN PATENT DOCUMENTS

| | | |
|---|---|---|
| ES | 2438171 T3 | 1/2014 |

* cited by examiner

*Primary Examiner* — Patrick Hamo

(57) ABSTRACT

A pumping system for fracking fluid is designed to provide nearly constant flow rate. The pumping system includes a set of linear actuator pumping units, each driven by an electric motor. Each pumping unit includes a first set of pumping chambers that expel fluid when the linear actuator is moving in a first direction and a second set of pumping chambers that expel fluid when the linear actuator is moving in an opposite direction. The speeds of the actuators are coordinated such that a total flow rate of the pumping system is substantially constant.

8 Claims, 4 Drawing Sheets

ELECTRIC OFF-AXIS OPPOSING PISTON LINEAR ACTUATOR PUMPING SYSTEM

CROSS-REFERENCE TO RELATED APPLICATIONS

This application claims priority to U.S. Provisional Application 62/963,575 filed Jan. 21, 2020, the entire disclosure of which is incorporated by reference herein.

TECHNICAL FIELD

The disclosure relates to a pumping system. More particularly, it relates to a pumping system to pump fluid at a nearly constant flow rate.

BACKGROUND

The practice of fracking has greatly increased the amount of oil and natural gas produced within the United States. Fracking involves pumping large quantities of fluid into wells. Conventionally, this is accomplished by reciprocating pumps driven by diesel engines. Due to the availability of natural gas on site, it would be preferable to use electric power from natural gas turbine driven generators.

Conventional fracking pumps utilize a crankshaft and connecting rod mechanism to convert rotational motion into axial reciprocating motion of a piston. Each cycle of the piston produces a pulse of flow, with the flow rate during each pulse being a function of the crankshaft and connecting rod geometry. Use of a large number of pistons with offset pulses allows the total flow rate to be smoothed out, but never completely constant. The variations in flow rate are called flow ripple. Flow ripple causes pressure pulses that increase failure rates of various components in the system. Also, for a given system size, such a pump has a very limited stroke distance. Therefore, many strokes per unit time are required to achieve a desired flow rate. This increases wear on valves which must open and close once per stroke.

SUMMARY

A pumping unit includes a housing, a shaft, a linear actuator, and two sets of pistons. The housing defines a central cavity and a plurality of bores radially around the central cavity. The housing may be machined as a single unit. The shaft extends through the central cavity. The linear actuator within the central cavity is configured to translate the shaft. A first set of pistons extends from a first subset of the bores and is linked to a first end of the shaft, by a first arm for example. A second set of pistons extends from a second subset of the bores and is linked to a second end of the shaft, by a second arm, for example, on an opposite side of the housing from the first end of the shaft. A plurality of valve units may be fixed the housing at the ends of the bores opposite the pistons. Bellows may extend between the housing and the arms, surrounding the shaft and sealing the cavity.

A pumping system includes a set of pumping units as described above and a controller. The controller is configured to vary a flow rate of each of the pumping units such that a total flow rate is substantially constant. The flow rate of each pumping unit may include a series of alternating increasing phases and decreasing phases. Each increasing phase may be coordinated with a decreasing phase of another of the pumping units. Similarly, each decreasing phase may be coordinated with an increasing phase of another of the pumping units. Each decreasing phase may be separated from the previous increasing phase by a constant flow phase.

DETAILED DESCRIPTION

Embodiments of the present disclosure are described herein. It should be appreciated that like drawing numbers appearing in different drawing views identify identical, or functionally similar, structural elements. Also, it is to be understood that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The terminology used herein is for the purpose of describing particular aspects only, and is not intended to limit the scope of the present disclosure. Unless defined otherwise, all technical and scientific terms used herein have the same meaning as commonly understood to one of ordinary skill in the art to which this disclosure belongs. Although any methods, devices or materials similar or equivalent to those described herein can be used in the practice or testing of the disclosure, the following example methods, devices, and materials are now described.

Figure 1:
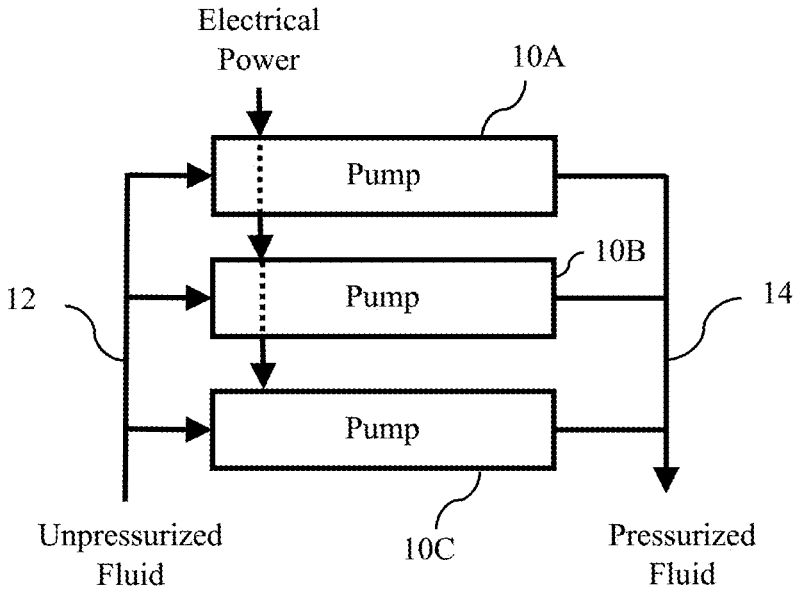
FIG. 1 is a schematic diagram of a pumping system with three pumping units.

FIG. 1 schematically illustrates an electric linear-actuator pumping system. The pumping system uses three pumping units 10A, 10B, and 10C. The number of pumping units may vary. The structure of each pumping unit is described in detail below. Each pumping unit uses electrical power to draw a fluid from a source of unpressurized fluid 12 and deliver the fluid at increased pressure to a fluid outlet 14.

Figure 2:
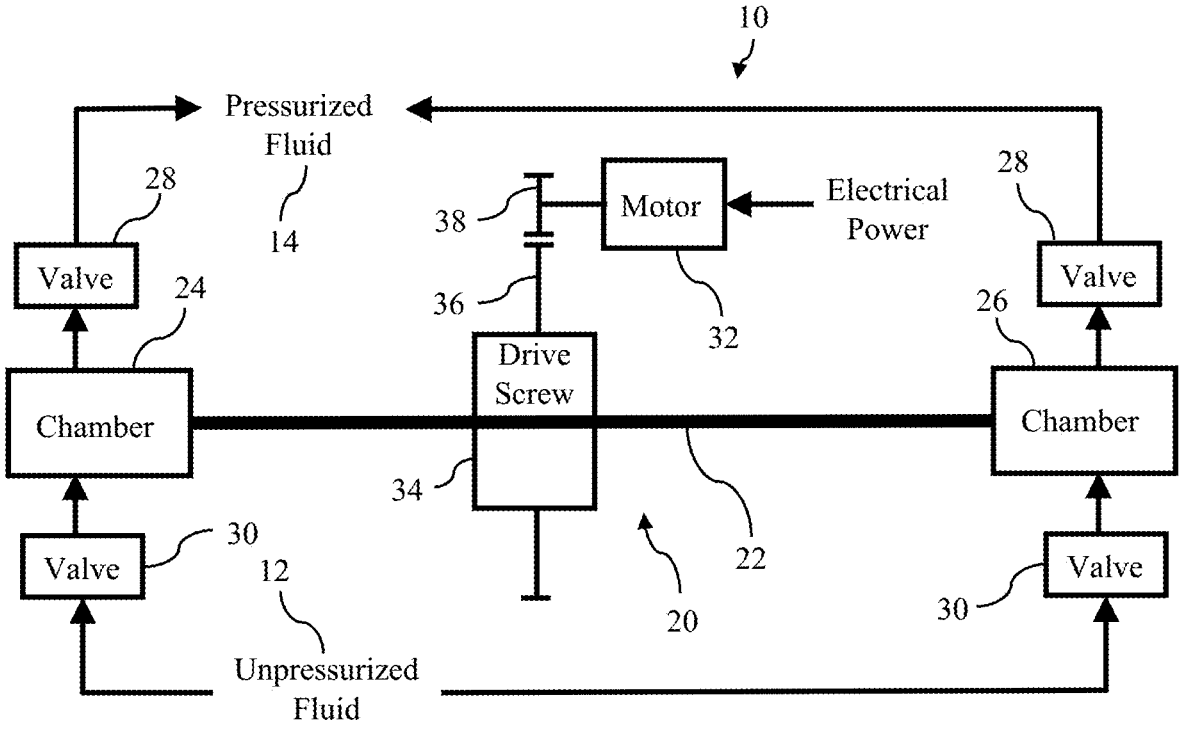
FIG. 2 is a schematic diagram of a linear actuator-based pumping unit suitable for use in the pumping system of FIG. 1.

FIG. 2 schematically illustrates the structure of each of the pumping units 10A, 10B, and 10C. Each pumping unit includes at least one electric linear actuator 20 which utilizes electrical power to translate a shaft 22. The shaft 22 may be hollow. Pumping chambers 24 and 26 have a volume that fluctuates based on the position of shaft 22. Specifically, leftward movement of shaft 22 decreases the volume of chamber 24 and increases the volume of chamber 26 by an equal amount. Chambers 24 and 26 may be formed, for example, by a cylinder/piston combination. Each pumping chamber draws fluid from the source of unpressured fluid 12 when its volume is increasing and delivers pressurized fluid to the output 14 when its volume is decreasing. Outlet valves 28 close as the volume is increasing to ensure that the fluid is drawn from source 12. Inlet valves 30 close as the volume is decreasing to ensure that the fluid is expelled to the outlet 14.

Each electric linear actuator 20 includes at least one electric motor 32 having a fixed stator and a rotatable rotor. The motors may be, for example, alternating current motors such as a permanent magnet synchronous motors. With a synchronous alternating current motor, the rotational speed of the rotor is adjusted by adjusting the frequency of the electric current using an inverter. With other types of motors, a speed or position feedback signal may be required. The motor 32 drives a nut of a planetary screw drive mechanism 34 as described, for example, in U.S. Pat. No. 9,267,588. Rotation of nut in response to rotation of rotor 32 causes shaft 22 to displace along its axis. The nut may be fixed to a ring gear 36 which meshes with a pinion gear 38 fixed to the rotor of the electric motor.

A control unit continually monitors a control signal or multiple control signals from a sitewide controller which controls multiple pumping systems. These signals indicate a desired flow rate and pressure from the pumping system. The controller calculates a trapezoidal motion profile for each actuator unit in the local pump system, the sum of which meets the demand. The controller utilizes various types of feedback signals which may include: back-emf voltage from the motors, current supplied to the motors, linear position sensors attached to the reciprocating portion of the pumps, rotary position sensors on the integrated nuts, pressure sensors in the fluid chambers of the pumps, strain sensors on the load-bearing elements of the pumps, and condition monitoring sensors in the bearings. The controller adjusts the motion of each actuator's motors to achieve: close adherence to the commanded motion profile, even sharing of torque load on each motor within an actuator unit, and protection from damaging conditions such as cavitation, low pressure, and incomplete fillage. The controller adjusts the motion profiles of each actuator unit in the local group to achieve: even wear and maximum life of each unit, real-time compensation for flow ripple (as discussed below), and special operating conditions as instructed by sitewide controller such as: pulsation or shockwave generation, ramp up/down, and/or idle. The controller relays real-time operating parameters (position, velocity, status) to the sitewide controller.

Figure 3:
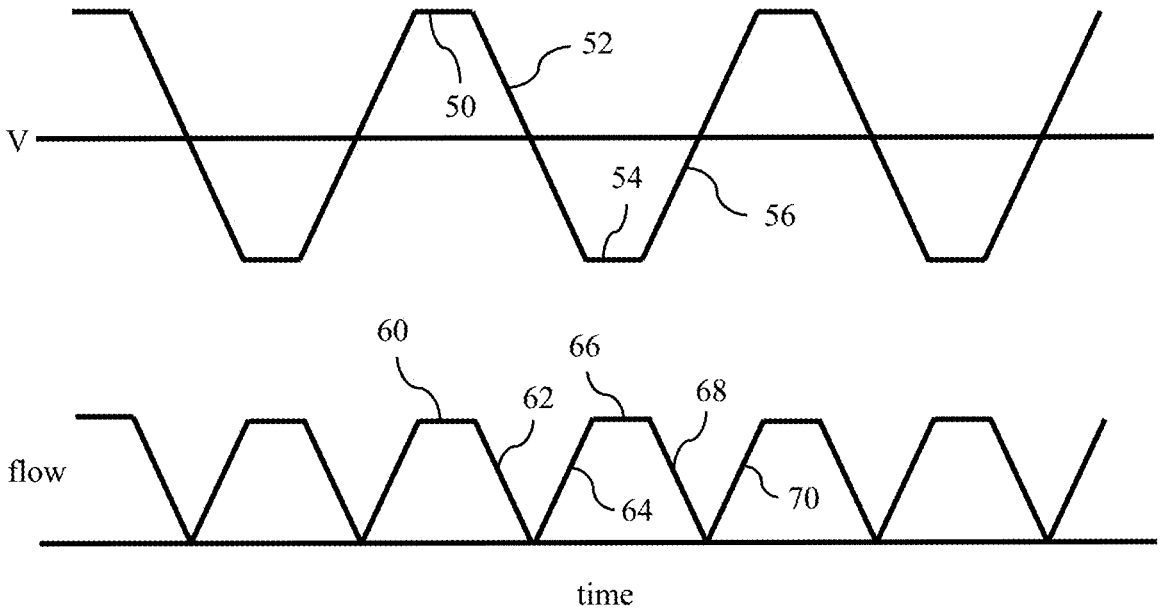
FIG. 3 is a graphical representation of the speed and flow rate of a pumping unit when operated such that the total flow for the pumping system is constant.

The top portion of FIG. 3 illustrates the velocity of shaft 22 as a function of time. During a first phase 50, the shaft moves in a positive direction at a steady speed. During a second phase 52, the shaft slows down at a steady rate. During the middle of the second phase, the shaft changes direction. During a third phase 54, the shaft moves in a negative direction at a steady speed, which is equal in magnitude to the speed of the first phase. Finally, during a fourth phase 56, the shaft accelerates at a steady rate equal to the rate of deceleration of the second phase. At the end of the fourth phase, the shaft has returned to its original position and speed and the process is repeated.

The bottom portion of FIG. 3 illustrates the fluid flow rate as a function of time. Note that the flow rate is proportional to the absolute value of the velocity. When the shaft is moving in a forward direction, flow is provided to the outlet from one of the pumping chambers. When the shaft is moving in a negative direction, flow is provided by the other pumping chamber. During the first phase 50, a constant flow rate 60 is provided by pumping chamber 26. During the first half of the second phase 52, the flow rate from pumping chamber 26 decreases to zero as shown at 62. During the second half of phase 52, the flow rate from pumping chamber 24 increases as shown at 64. During the third phase 54, a constant flow rate 66 is provided by pumping chamber 24. During the first half of the fourth phase 56, the flow rate from pumping chamber 24 decreases to zero as shown at 68. During the second half of phase 56, the flow rate from pumping chamber 26 increases as shown at 70.

With three pumping units, these phases are staggered to maintain constant total flow. At any given time, one pumping unit is operating in either phase 60 or 66, another pumping unit is operating in either phase 62 or 68, and a third pumping unit is operating in either phase 64 or 70. With three total pumping units, the length of phase 50 and 54 should be half as long as the length of phases 52 and 56. With different numbers of pumping units, the relative durations of the phases may be adjusted such that one unit is always in a declining flow phase and one unit is always in an increasing flow phase.

In addition to establishing a constant flow rate, the pumping system described above offers several advantages. Each of the pumping units has a relatively long stroke relative to its overall size. As a result, the valves do not need to open and close as often as they would for a shorter stroke pump at the same average flow rate. This improves the durability of the valves. Furthermore, the pumping system can continue to operate with one of the pumping units offline which simplifies maintenance.

Figure 4:
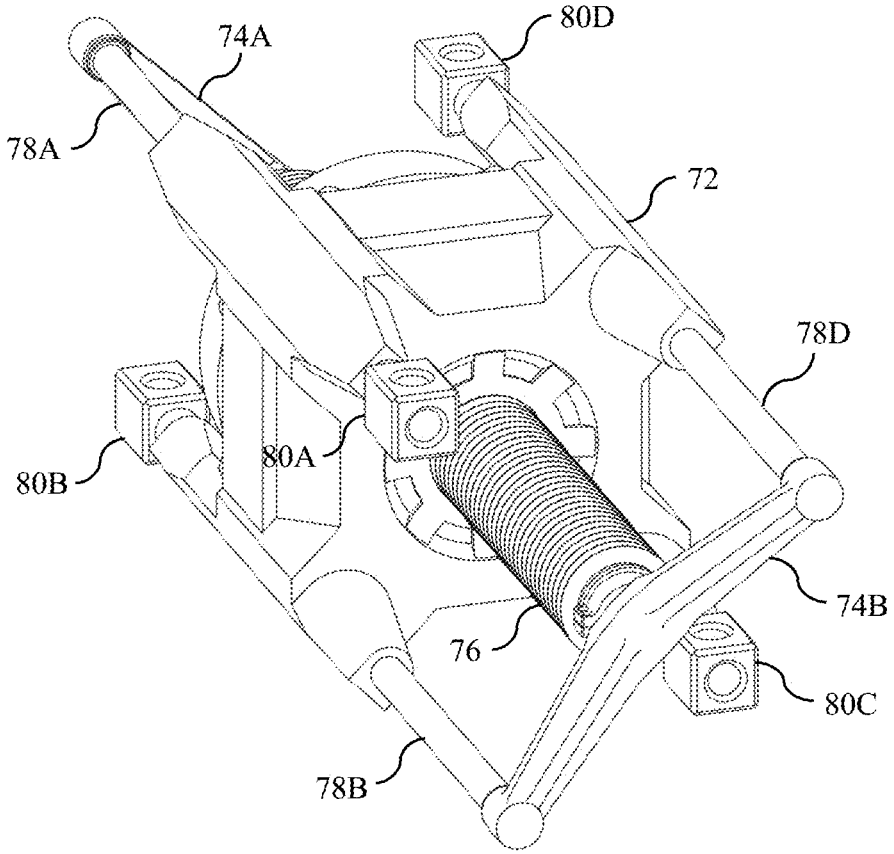
FIG. 4 is a pictorial view of one embodiment of a pumping unit of FIG. 2.
Figure 5:
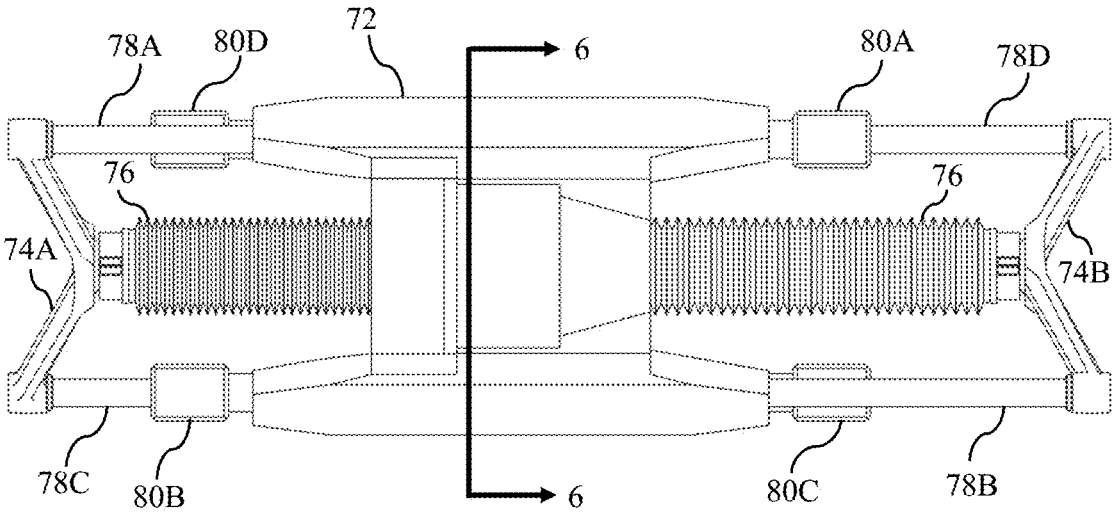
FIG. 5 is a front view of the pumping unit of FIG. 4.

FIGS. 4 and 5 show an exterior of pumping unit. FIG. 4 is a pictorial view whereas FIG. 5 is a front view. Some features may be apparent in only one of these views. The electric motors and linear actuator are supported inside housing 72. Shaft 22 (not visible) extends out both sides of housing 72. Arms 74A and 74B are attached to each end of shaft 22. Bellows 76 are attached at one end to housing 72 and at the other end to the end of shaft 22, to seal a central cavity of the housing 72 while permitting shaft 22 to translate. Four cylinder bores are defined in housing 72 around the central cavity. A piston extends out one end of each bore. Two of the pistons, 78A and 78C extend in one direction while pistons 78B and 78D extend in the opposite direction. Pistons 78A and 78C are fixed to arm 74A. Pistons 78B and 78D are fixed to arm 74B. Valve blocks 80A-80D are fixed to the end of each bore opposite the piston. Shaft 22, arms 74A and 74B, and pistons 78A-78D all translate together as a unit.

Figure 6:
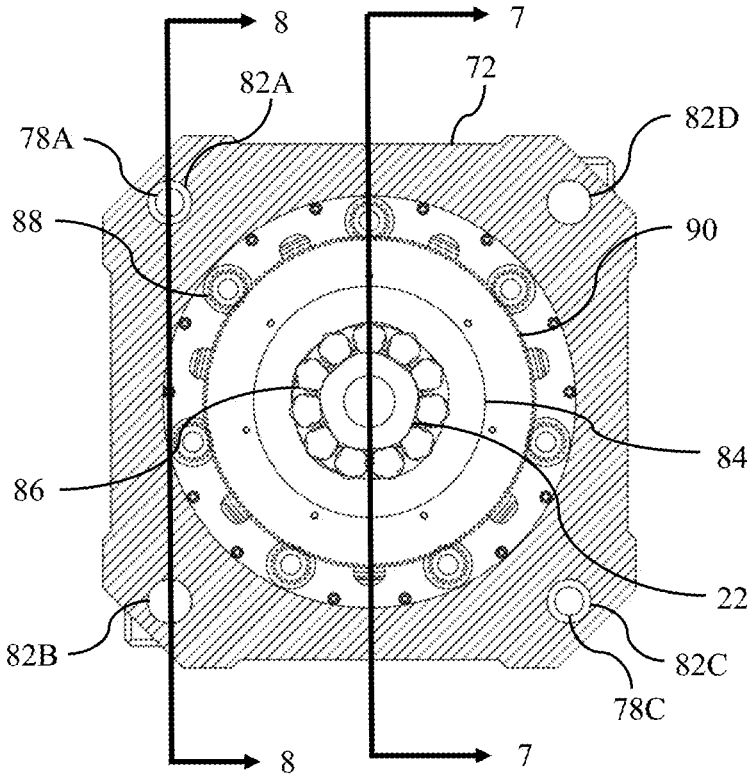
FIGS. 6-8 are cross sectional views of the pumping unit of FIG. 4.
Figure 7:
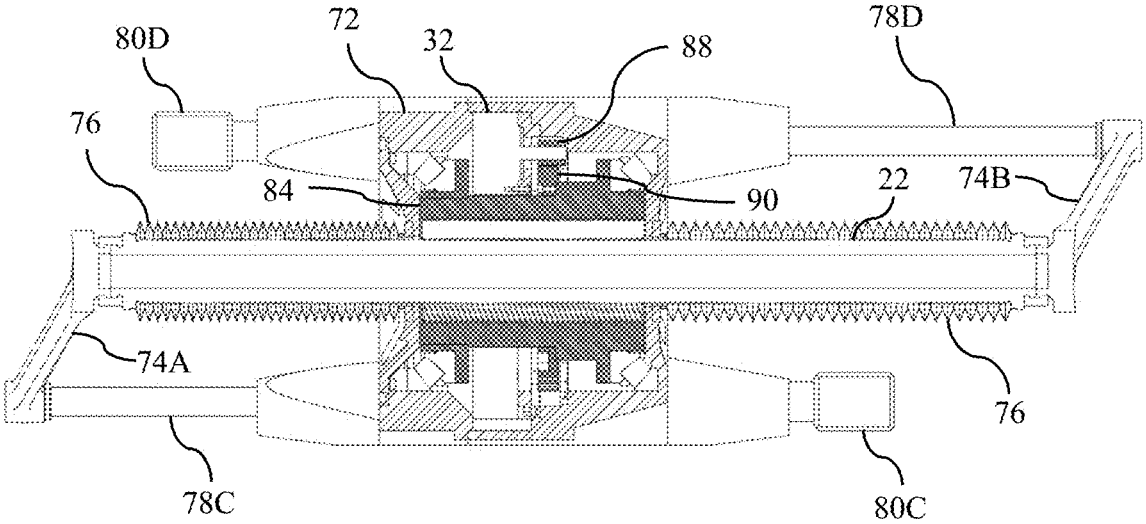
Figure 8:
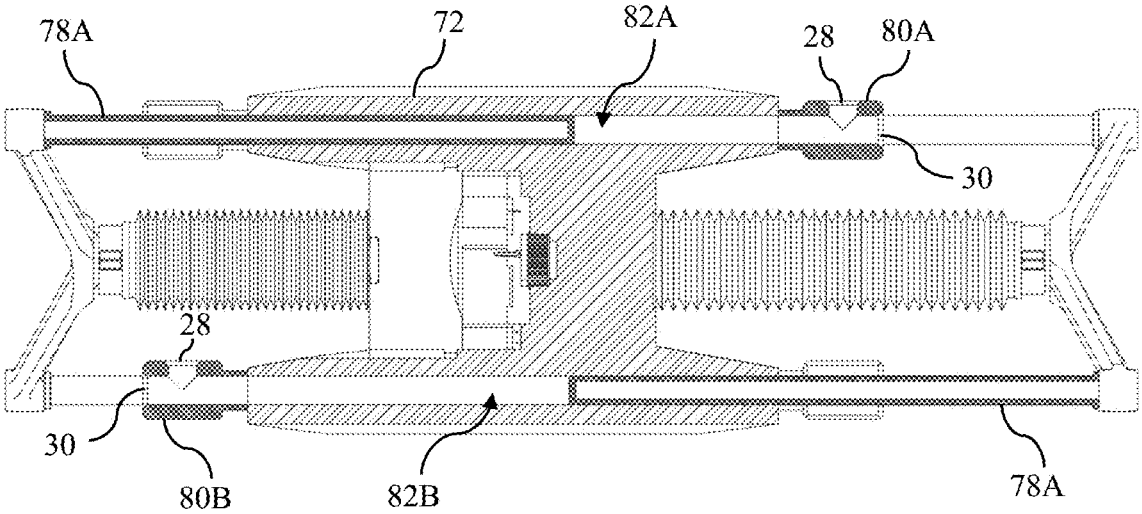

FIG. 6 is an end-view cross section of the pumping unit. The four cylinder bores 82A-82D are visible in this view. Planetary screw drive mechanism 34 includes rotatable nut 84, threaded shaft 22, and a plurality of threaded rollers 86. Rotation of nut 84 results in translation of shaft 22. Seven electric motors (not visible) each drive a pinion gear 88. A ring gear 90 is fixed to nut 84 and meshes with each of the pinion gears 88. FIGS. 7 and 8 show cross sections through the linear actuator and through two of the cylinder bores respectively.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. As such, to the extent any embodiments are described as less desirable than other embodiments or prior art implementations with respect to one or more characteristics, these embodiments are not outside the scope of the disclosure and can be desirable for particular applications.

What is claimed is:

1. A pumping unit comprising:

a housing defining a central cavity and a plurality of bores radially around the central cavity;

a shaft extending through the central cavity;

a linear actuator within the central cavity configured to translate the shaft;

a first set of pistons extending from a first subset of the bores and linked to a first end of the shaft; and a second set of pistons extending from a second subset of the bores and linked to a second end of the shaft, the second end of the shaft on an opposite side of the housing from the first end of the shaft.

2. The pumping unit of claim 1 further comprising a plurality of valve units, each valve unit fixed the housing at an end of a bore opposite a corresponding piston.

3. The pumping unit of claim 1 wherein:

the first set of pistons is linked to the first end of the shaft by a first arm; and the second set of pistons is linked to the second end of the shaft by a second arm.

4. The pumping unit of claim 3 further comprising:

a first bellows extending between the housing and the first arm, surrounding the shaft; and a second bellows extending between the housing and the second arm, surrounding the shaft, the first and second bellows sealing the central cavity.

5. The pumping unit of claim 1 wherein the housing is machined as a single unit.

6. A pumping system comprising:

a plurality of pumping units according to claim 1; and a controller configured to vary a flow rate of each of the pumping units such that a total flow rate is substantially constant.

7. The pumping system of claim 6 wherein the flow rate of each pumping unit includes a series of alternating increasing phases and decreasing phases, each increasing phase coordinated with a decreasing phase of another of the pumping units, each decreasing phase coordinated with an increasing phase of another of the pumping units.

8. The pumping system of claim 7 wherein each decreasing phase is separated from a previous increasing phase by a constant flow phase.

* * * * *